US007975624B2

(12) United States Patent
Henriott

(10) Patent No.: US 7,975,624 B2
(45) Date of Patent: Jul. 12, 2011

(54) MULTI-PURPOSE TABLE WITH ELECTRICAL FEATURES

(75) Inventor: Jay M. Henriott, Jasper, IN (US)

(73) Assignee: Kimball International, Inc., Jasper, IN (US)

( * ) Notice: Subject to any disclaimer, the term of this patent is extended or adjusted under 35 U.S.C. 154(b) by 488 days.

(21) Appl. No.: 12/122,099

(22) Filed: May 16, 2008

(65) Prior Publication Data

US 2008/0295744 A1 Dec. 4, 2008

Related U.S. Application Data

(63) Continuation-in-part of application No. 11/754,479, filed on May 29, 2007.

(51) Int. Cl.
*A47B 37/00* (2006.01)

(52) U.S. Cl. ..... 108/50.02; 312/223.6

(58) Field of Classification Search ..... 108/50.01, 108/50.02, 6, 7, 115; 312/223.6, 223.3; 248/900, 248/906

See application file for complete search history.

(56) References Cited

U.S. PATENT DOCUMENTS

| | | | | |
|---|---|---|---|---|
| 1,902,424 | A | | 3/1933 | Sherman |
| 1,916,537 | A | | 7/1933 | Smith |
| 3,148,746 | A | | 9/1964 | Juculano |
| 3,227,487 | A | | 1/1966 | Blanchard, Jr. et al. |
| 3,281,184 | A | | 10/1966 | Axtell |
| 3,635,174 | A | | 1/1972 | Ball et al. |
| 3,982,785 | A | | 9/1976 | Ambasz |
| 4,300,371 | A | | 11/1981 | Herwick et al. |
| 4,372,629 | A | * | 2/1983 | Propst et al. ..... 312/223.6 |
| 4,535,703 | A | | 8/1985 | Henriott et al. |
| 4,570,465 | A | | 2/1986 | Bennett |
| 4,688,869 | A | * | 8/1987 | Kelly ..... 439/209 |
| 4,734,826 | A | * | 3/1988 | Wilson et al. ..... 361/827 |
| 4,748,913 | A | | 6/1988 | Favaretto et al. |
| 4,879,954 | A | | 11/1989 | Sawamura et al. |
| 4,941,412 | A | * | 7/1990 | Engel ..... 108/156 |

(Continued)

FOREIGN PATENT DOCUMENTS

EP 0 179 410 11/2008

OTHER PUBLICATIONS

Canadian Office Action dated Mar. 29, 2010, in corresponding Canadian Application No. 2,631,965.

(Continued)

*Primary Examiner* — Darnell M Jayne
*Assistant Examiner* — Andres Gallego
(74) *Attorney, Agent, or Firm* — Baker & Daniels LLP

(57) ABSTRACT

A multi-purpose table including a channel that either forms a portion of, or is attached to, a horizontal support structure of the work surface of the table. The channel includes at least one trough for managing cables and cords associated with electrical and communication outlet modules. The electrical and communication outlet modules may be installed within the channel with the outlets accessible to a user of the table when the work surface is positioned in each of a horizontal use position and a vertical storage position. In one embodiment, individual outlet modules are installed within the channel by a snap-fit engagement. In another embodiment, the outlet modules are provided as part of a harness or bus assembly that is slidably installed and retained within the channel.

9 Claims, 7 Drawing Sheets

U.S. PATENT DOCUMENTS

| | | | | |
|---|---|---|---|---|
| 5,129,703 | A | 7/1992 | Ballendat et al. | |
| 5,231,562 | A * | 7/1993 | Pierce et al. | 361/832 |
| 5,282,669 | A | 2/1994 | Barile | |
| 5,318,454 | A | 6/1994 | Deer et al. | |
| 5,336,097 | A | 8/1994 | Williamson, Jr. et al. | |
| 5,381,685 | A | 1/1995 | Carl et al. | |
| 5,606,919 | A | 3/1997 | Fox et al. | |
| 5,640,912 | A | 6/1997 | Diffrient | |
| 5,709,110 | A | 1/1998 | Greenfield et al. | |
| 5,794,545 | A | 8/1998 | McDaniel et al. | |
| 5,886,295 | A | 3/1999 | Carino et al. | |
| 5,927,214 | A | 7/1999 | Schwartz et al. | |
| 5,971,508 | A | 10/1999 | Deimen et al. | |
| 5,971,509 | A | 10/1999 | Deimen et al. | |
| 6,202,567 | B1 | 3/2001 | Funk et al. | |
| 6,252,171 | B1 * | 6/2001 | Barr | 174/95 |
| 6,336,414 | B1 | 1/2002 | Stewart et al. | |
| 6,435,106 | B2 * | 8/2002 | Funk et al. | 108/50.02 |
| 6,637,352 | B1 | 10/2003 | Thode et al. | |
| 6,647,900 | B1 | 11/2003 | Kopish | |
| 6,817,684 | B2 | 11/2004 | Cattaneo | |
| 6,845,723 | B2 | 1/2005 | Kottman et al. | |
| 7,013,685 | B2 | 3/2006 | Francke | |
| 7,066,098 | B2 | 6/2006 | Blasen et al. | |
| 2004/0035157 | A1 | 2/2004 | Petrick et al. | |
| 2004/0237854 | A1 | 12/2004 | Piretti | |
| 2005/0028571 | A1 | 2/2005 | Merrem et al. | |
| 2005/0193930 | A1 * | 9/2005 | Hartel et al. | 108/106 |
| 2005/0284341 | A1 * | 12/2005 | Klassy et al. | 108/50.02 |
| 2006/0081156 | A1 * | 4/2006 | Gayhart et al. | 108/50.02 |
| 2006/0230991 | A1 | 10/2006 | Piretti | |
| 2008/0295742 | A1 | 12/2008 | Henriott | |

OTHER PUBLICATIONS

Non-Final Office Action dated Mar. 25, 2010 in corresponding U.S. Appl. No. 11/754,479 and Amendment filed Jun. 17, 2010.

Final Office Action dated Sep. 9, 2010 in corresponding U.S. Appl. No. 11/754,479 and Amendment dated Nov. 23, 2010.

* cited by examiner

MULTI-PURPOSE TABLE WITH ELECTRICAL FEATURES

CROSS-REFERENCE TO RELATED APPLICATIONS

This application is a continuation-in-part of U.S. patent application Ser. No. 11/754,479, entitled MULTI-PURPOSE TABLE WITH ELECTRICAL FEATURES, filed on May 29, 2007, the entire disclosure of which is incorporated by reference herein.

BACKGROUND

1. Field of the Invention

The present invention relates to a multi-purpose table and, in particular, the present invention relates to a multi-purpose table having a channel for managing electrical and communication cables and outlets.

2. Description of the Related Art

Articles of office furniture, such as tables, are often used in environments which require electrical outlets and/or communication outlets near a work surface, such that a user may plug an electrical cord into the electrical outlet to power a device positioned on or proximate the article of furniture, or may plug a communication cable into the communication outlet to provide service to a device positioned on or proximate the article of furniture. Some municipalities allow articles of furniture to include electrical outlets having power supplied thereto via extension cords that are plugged into existing power outlets in a building or other structure in which the article of furniture is positioned. Other municipalities do not permit such extension cords and instead require that power that is supplied to the electrical outlets of the article of furniture are "hard wired" or fully contained within the article of furniture and are not connected to existing power outlets via extension cords.

Also, articles of furniture such as tables may be movable, particularly when same are used in a training or educational setting, in which the tables are often moved between use and storage locations and/or are reconfigured in different positions based on the dynamic needs of the environment. When it is necessary to supply power to peripheral devices used with the tables, such as computers and projectors, electrical and data cord management may present a challenge.

What is needed is an article of furniture having electrical and/or data supply and cord management features that is an improvement over the foregoing.

SUMMARY

The present invention provides a multi-purpose table including a channel that either forms a portion of, or is attached to, a horizontal support structure of the work surface of the table. The channel includes at least one trough for managing cables and cords associated with electrical and communication outlet modules. The electrical and communication outlet modules may be installed within the channel with the outlets accessible to a user of the table when the work surface is positioned in each of a horizontal use position and a vertical storage position. In one embodiment, individual outlet modules are installed within the channel by a snap-fit engagement. In another embodiment, the outlet modules are provided as part of a harness or bus assembly that is slidably installed and retained within the channel.

In one form thereof, the present invention provides an article of furniture, including a support structure; a work surface supported by the support structure, the work surface movable with respect to the support structure between a horizontal position and a vertical position; a channel connected to the support structure, the channel disposed beneath and spaced from the work surface; and at least one outlet module removably mounted within the channel.

In another form thereof, the present invention provides a table, including a support structure including a plurality of legs having wheels; a work surface supported by the support structure, the work surface pivotable with respect to the support structure between a horizontal position and a vertical position; a horizontal channel connected to the support structure, the channel disposed beneath and spaced from the work surface, the channel including a first trough and a second trough, the first trough facing in a horizontal direction and the second trough facing in a vertical direction; and at least one outlet module removably mountable within at least one of the first and second troughs.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplary embodiments of the invention illustrated herein are not to be construed as limiting the scope of the invention in any manner.

DETAILED DESCRIPTION

Figure 1:
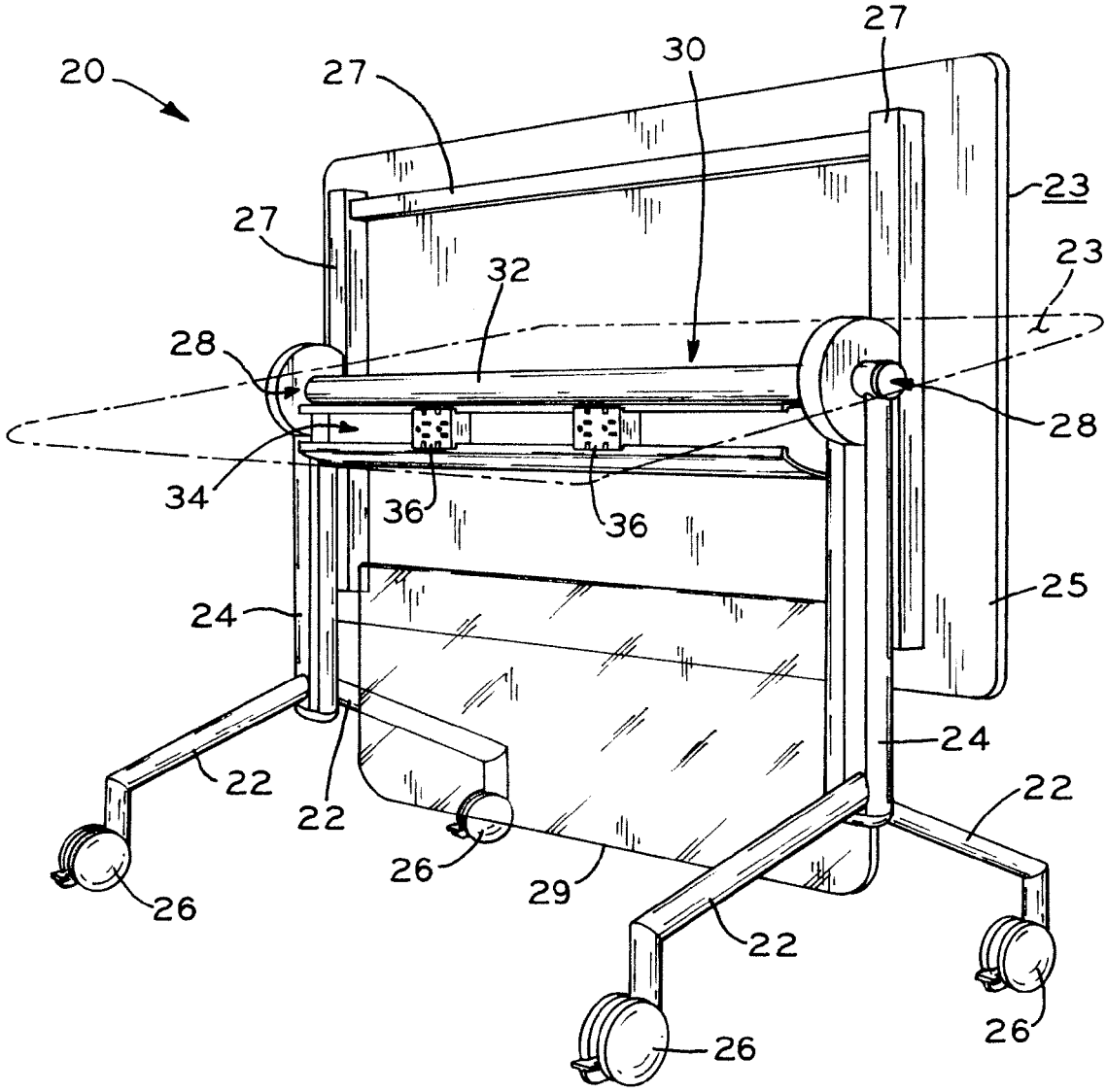
FIG. 1 is a perspective view of a multi-purpose table according to one embodiment of the present invention.

Referring to FIG. 1, multi-purpose table 20 is shown, and generally includes a plurality of legs 22, caster wheels 26, and two upright supports 24 for supporting table top 25. Table top 25 includes a planar work surface 23 and a support frame or structure 27. Support structure 27 may be attached to a pair of rotation mechanisms 28 that are respectively positioned at opposite ends of table 20. Rotation mechanisms 28 are provided to permit rotation of work surface 23 between a generally vertical, storage position, shown in solid lines in FIG. 1, and a generally horizontal, use position, shown in dashed lines in FIG. 1, thereby facilitating storage and movement of table 20. Rotation mechanisms 28 are commercially available from OMT/Veyhl of Zwerenberg, Germany, and may include suitable actuation and locking mechanisms for actuation by a user to adjust the position of table top 25 and/or to lock the position of table top 25 in its horizontal or vertical positions.

Figure 8:
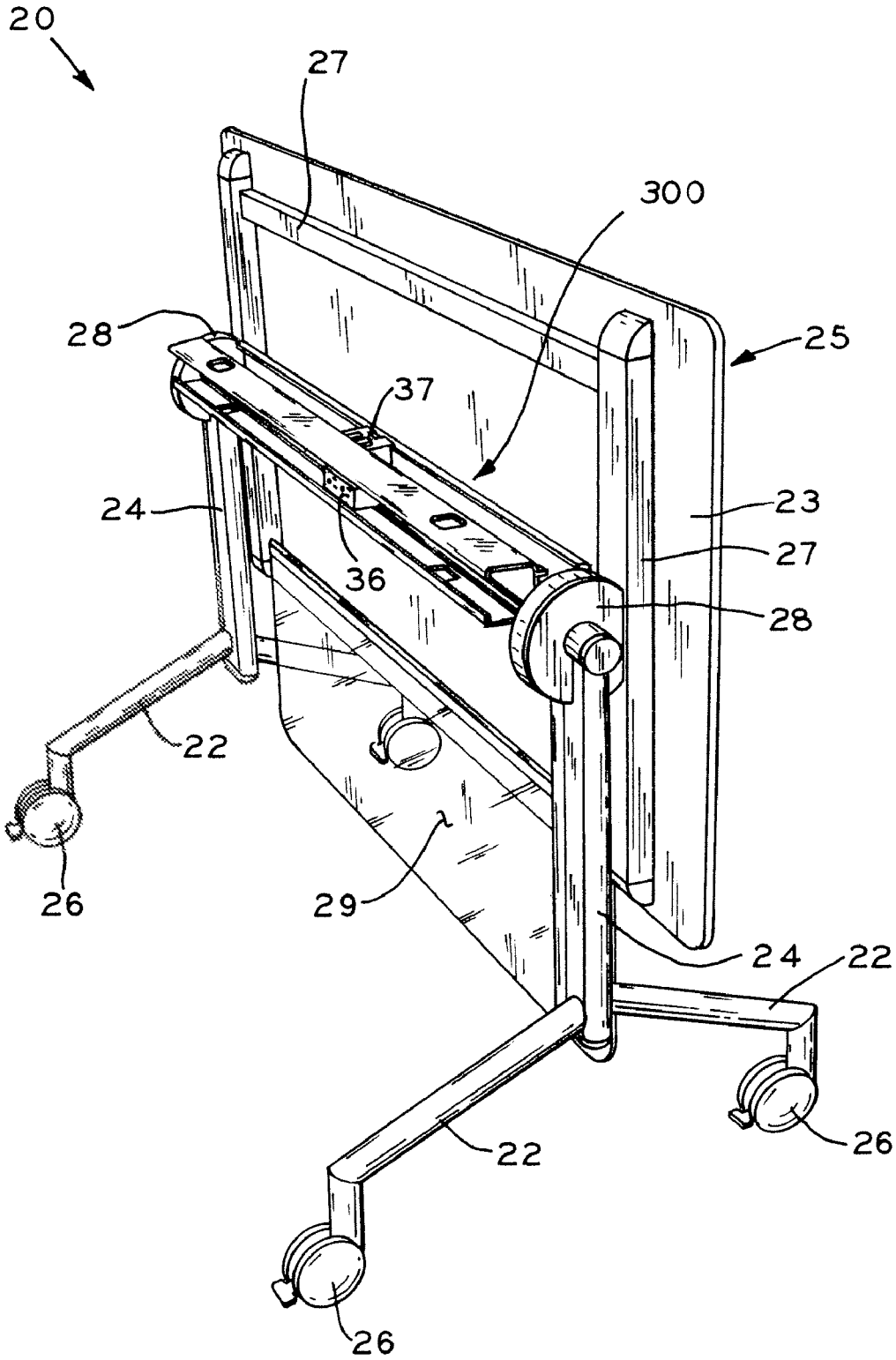
FIG. 8 is a perspective view of a multi-purpose table having a channel according to another embodiment of the present invention.

Table 20 may also include a modesty panel 29 made of an opaque or translucent material and which, as shown in FIGS. 1 and 8, is pivotably connected to the underside of table top 25 and hangs vertically therebeneath in each of the horizontal and vertical positions of table top 25.

Table 20 further includes channel 30, which includes cross bar 32 and trough 34 for housing and maintaining snap-in electrical outlet module 36, communication outlet module 37 (FIG. 3A), and optionally a plurality of various cords and cables 48 (FIG. 3) associated with the outlets. Cross bar 32 may form a horizontal support rod or structure extending between upright supports 24 of table 20.

Figure 2:
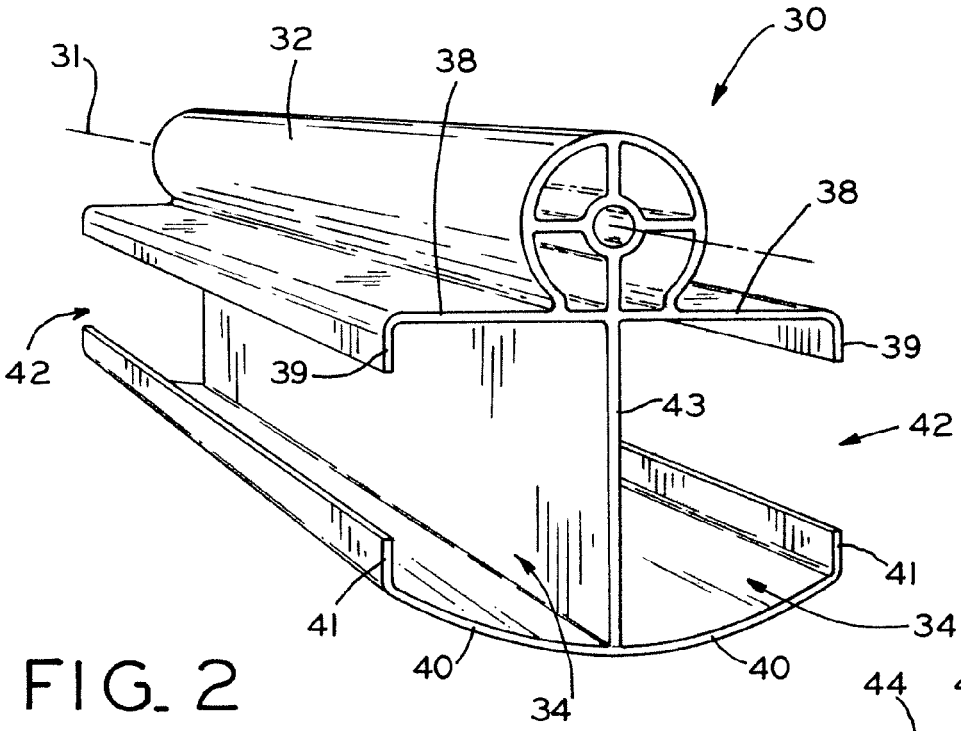
FIG. 2 is a perspective view of the channel of the table shown in FIG. 1.
Figure 3A:
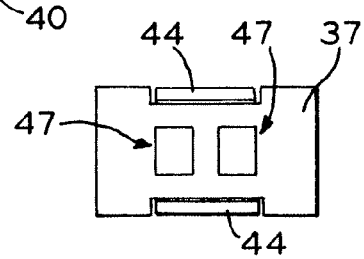
FIG. 3A is a front view of a data services outlet module.
Figure 3:
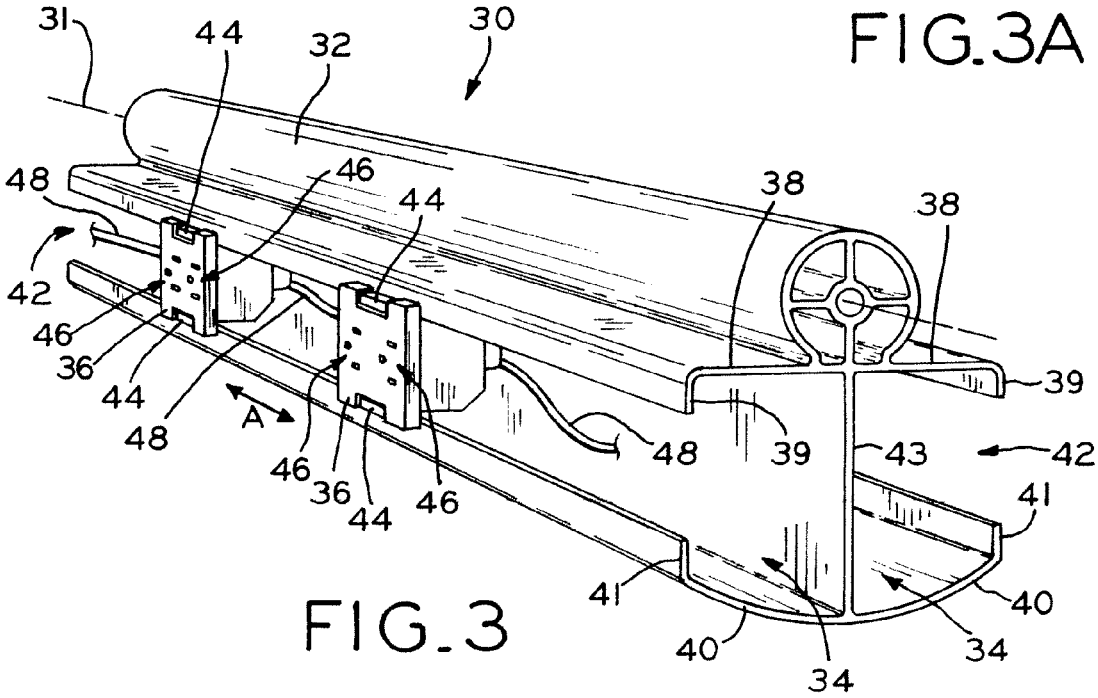
FIG. 3 is a perspective view of the channel of FIG. 2, further illustrating a plurality of snap-in electrical outlet modules.

Referring now to FIGS. 2 and 3, channel 30 is shown and may be formed from an extruded aluminum material. Alternatively, channel 30 may be formed of any other suitable metal or from a plastic material or a combination of plastic and metal. Channel 30 may integrally include cross bar 32 of table 20 which is a structural member and defines axis 31 about which rotation mechanism 28 (FIG. 1) rotates table top 25 and work surface 23 (FIG. 1) during rotation of table top 25 between its horizontal and vertical positions, though in the present embodiment, cross bar 32 itself does not rotate. Channel 30 is disposed beneath, and is spaced from, the underside of work surface 23.

Channel 30 further defines at least one trough 34 having upper horizontal flange 38 and lower horizontal flange 40. Upper vertical flange 39 extends generally downwardly from upper horizontal flange 38 and lower vertical flange 41 extends generally upwardly from lower horizontal flange 40. Vertical upper flange 39 in combination with vertical lower flange 41 defines opening 42 which extends substantially along a longitudinal length of channel 30. Vertical support panel or wall 43 extends from a central portion of lower flange 40 to a central portion of upper flange 38 and may provide a vertical barrier to define two separate troughs 34 as well as provide structural support to channel 30. Each trough 34 of vertical support panel 43 may include identical features, such as vertical upper flange 39 and vertical lower flange 41.

Figure 5:
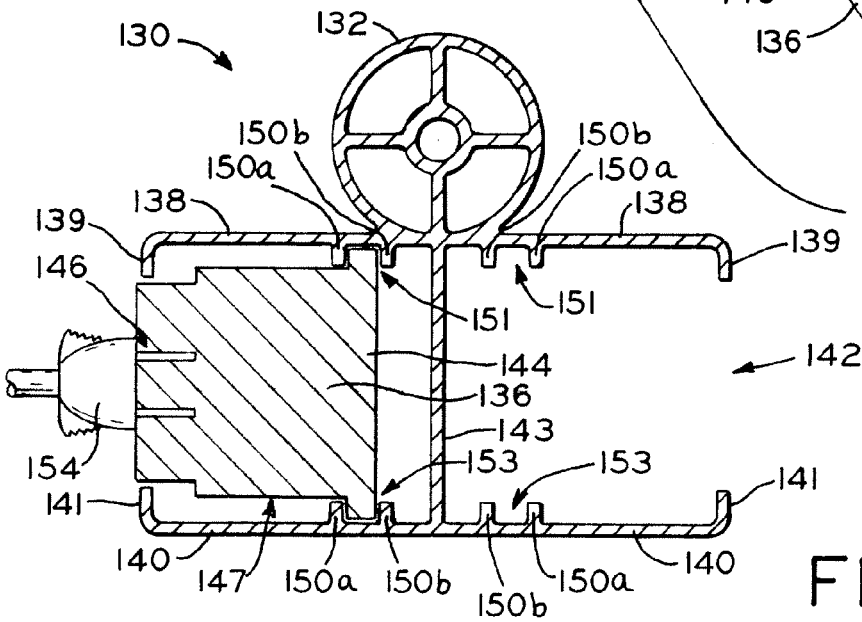
FIG. 5 is a cross-sectional view of the assembled channel and electrical harness assembly of FIG. 4.

As shown in FIG. 3, each electrical outlet module 36 may include a set of resilient tangs or buttons 44 on opposing sides thereof which may optionally additionally include barbs or other retaining structure, and provide snap-fit engagement with vertical upper flange 39 and vertical lower flange 41, as described below, to retain electrical outlet module 36 in any selected position along the length of channel 30. Snap-in electrical outlet module 36 further may include at least one electrical AC and/or DC outlet 46 for receipt of electrical plug 154 (FIG. 5).

To assemble channel 30 and a snap-in electrical outlet module 36, a user may position electrical outlet module 36 proximate opening 42 such that electrical outlet 46 of module faces away from channel 30. The user may depress resilient tangs 44 and then position electrical outlet module 36 between upper flange 38 and lower flange 40 such that electrical outlet module 36 is positioned within opening 42 between vertical upper flange 39 and vertical lower flange 41. The user may then release resilient tangs 44 to secure electrical outlet module 36 in a desired position in channel 30. In another method, a user may position electrical outlet module 36 proximate opening 42 such that electrical outlet 46 faces away from channel 30 and then the user may force electrical outlet module 36 into channel 30. Resilient tangs 44 are biased inward upon contacting vertical upper flange 39 and vertical lower flange 41. Once electrical outlet module 36 has been pushed further into channel 30, resilient tangs 44 are returned to an unbiased state such that electrical outlet module 36 is securely positioned in channel 30. Electrical outlet module 36 may also be slid along a direction substantially parallel to axis 31 by depressing resilient tangs 44 and manually sliding electrical outlet module 36 within opening 42 along a general direction denoted by Arrow A until a desired position is determined. Resilient tangs 44 are then released and electrical outlet module 36 is again secured in the desired position. Once resilient tangs 44 are released, electrical outlet module 36 is retained in position relative to channel 30, thereby preventing sliding and radial movement relative to axis 31 of channel 30.

Electrical outlet modules 36 may be stand-alone electrical components which do not need any jumper connections. In another embodiment, electrical outlet modules 36 are hard-wired electrical components which are joined together via electrical wires and/or cables 48 which provide power to electrical modules 36. In yet another embodiment, electrical outlet modules 36 are attached via wires or extension cords to an existing outlet in a building or other structure in which table 20 is positioned to provide power to electrical outlet modules 36.

As shown in FIG. 3A, in addition to, or in place of, electrical outlet modules 36, communication outlet modules 37 may also be used in a similar manner with channel 30. Communication outlet modules 37 may be AMP-style data ports, any suitable telephone, cable, internet, or Ethernet connections, and include communication outlets 47 and resilient tangs 44. Communication outlet module 37 may be positioned in channel 30 in the same or similar manner as described above with respect to electrical outlet modules 36. At least one communication outlet module 37 and at least one electrical outlet module 36 may be positioned in the same trough 34 or may be positioned in opposite troughs 34 on each side of vertical support panel 43. In one embodiment, electrical outlet modules 36 are positioned in one trough 34 of channel 30 and communication outlet modules 37 are positioned on the opposite trough 34 on the other side of channel 30.

In operation, as work surface 23 of table 20 is rotated from a vertical, storage position (FIG. 1, solid lines) to a horizontal, use position (FIG. 1, dashed lines), channel 30 remains stationary such that openings 42 in channel 30 advantageously provide access to troughs 34 of channel 30, which itself remains parallel to, and fixed with respect to, the ground surface upon which table 20 is positioned. Moreover, any cables or other electrical and/or communication cords such as cords/cables 48 that are positioned in troughs 34 are not twisted or otherwise interfered with during rotational movement of work surface 23 between the foregoing positions. Further, access openings 42 are optionally provided within flanges 38 and 40 on either side of channel 30 to provide access to troughs 34 from below and above channel 30 on each side of table 20.

Figure 4:
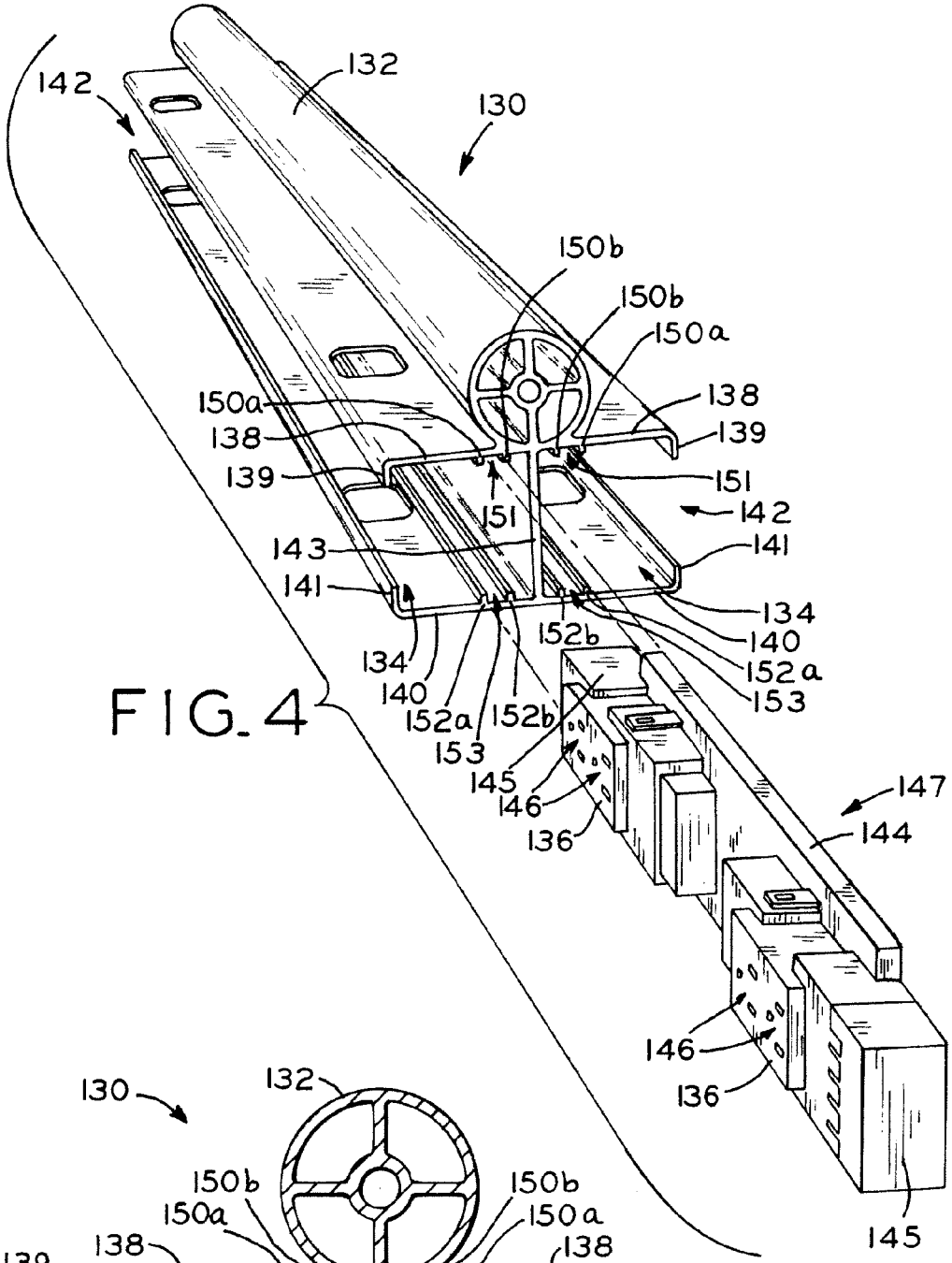
FIG. 4 is an exploded perspective view of a channel according to another embodiment of the present invention, further illustrating an electrical harness assembly insertable into the channel.

Referring now to FIGS. 4 and 5, channel 130 according to another embodiment is shown and, except as described below, is substantially identical to channel 30 described above with reference to FIGS. 1-3. Channel 130 generally includes cross bar 132, upper flange 138, and lower flange 140. Channel 130 may also include vertical support panel or wall 143 extending between upper flange 138 and lower flange 140 to provide a vertical barrier to define two separate troughs 134 as well as structural support to channel 130. Vertical upper flange 139 extends generally downward from upper flange 138 and vertical lower flange 141 extends generally upward from lower flange 140 to define opening 142 in channel 130. Upper vertical flanges 150*a*, 150*b* also extend generally downward from upper flange 138 and lower vertical flanges 152*a*, 152*b* extend generally upward from lower flange 140 to respectfully define a pair of mutually-facing channels 151, 153. Channels 151, 153 may be sized to slidingly receive at least a portion of electrical harness assembly 147 therein, as described below. Each trough 134 on either side of channel 130 may include identical features, such as vertical upper flange 139, vertical lower flange 141, and channels 151, 153.

Electrical harness assembly 147 may include mounting board 144 formed as a rectangular piece of material on which at least one electrical connector 145 is mounted. Each electrical connector 145 may be releasably connected to at least one electrical outlet module 136. Electrical outlet modules 136 may each include at least one electrical AC and/or DC outlet 146 for receipt of plug 154 (FIG. 5). Electrical harness assembly 147 may be slidably received and retained within channel 130 via interaction of mounting board 144 and channels 151, 153. Once mounting board 144 of electrical harness assembly 147 is positioned within channels 151, 153 of channel 130, electrical module 136 is exposed through opening 142 such that plug 154 may be easily inserted into outlet 146, as shown in FIG. 5. An exemplary electrical system including electrical harness assembly 147 is an "8-10 Electrical System", available from Dekko Engineering, a Group Dekko Company, of Kendallville, Ind.

Electrical outlet modules 136 may be stand-alone electrical components which do not need any jumper connections. In another embodiment, electrical outlet modules 136 are hard-wired electrical components which are joined together via electrical wires and/or cables, for example, cords/cables 48 (FIG. 3), which provide power to electrical outlet modules 136. In yet another embodiment, electrical outlet modules 136 are attached via wires or extension cords to an existing outlet in a building or other structure in which table 20 is positioned to provide power to electrical outlet modules 136.

In addition to, or in place of, electrical outlet modules 136, communication outlet modules may also be used in a similar manner with channel 130. The communication outlet modules may be AMP-style data ports, such as telephone, cable, internet, or Ethernet connections. The communication outlet modules may be positioned in channel 130 in a similar manner as described above with respect to electrical outlet modules 136. At least one communication outlet module and at least one electrical outlet module 136 may be positioned in the same trough 134 or may be positioned in opposite troughs 134 on each side of vertical support panel 143.

Moreover, snap-in electrical outlet modules 36 (FIG. 3) and communication outlet modules 37 (FIG. 3A) can be used with channel 130 in a similar manner as with channel 30 (FIGS. 1-3) described above. For example, flanges 139 and 141 may cooperate to snap-fittingly receive outlet modules 36 and/or outlet modules 37 in a similar manner as flanges 39 and 41 (FIGS. 2 and 3) described above.

Advantageously, channel 130 may be used in situations requiring either a "soft-wired" configuration in which the electrical outlet modules are connected via extension cords or other cables to existing outlets in the building or other structure in which table 20 is positioned, or a "hard-wired" configuration in which the electrical modules are connected via contained or shielded power supplies and do not connect to existing outlets in the building or other structure. Thus, a manufacturer could incorporate channel 130 into table 20 and advantageously be able to sell table 20 to buyers in a municipalities that require "hard-wired" configurations or buyers in municipalities which do not require "hard-wired" configurations.

Figure 6:
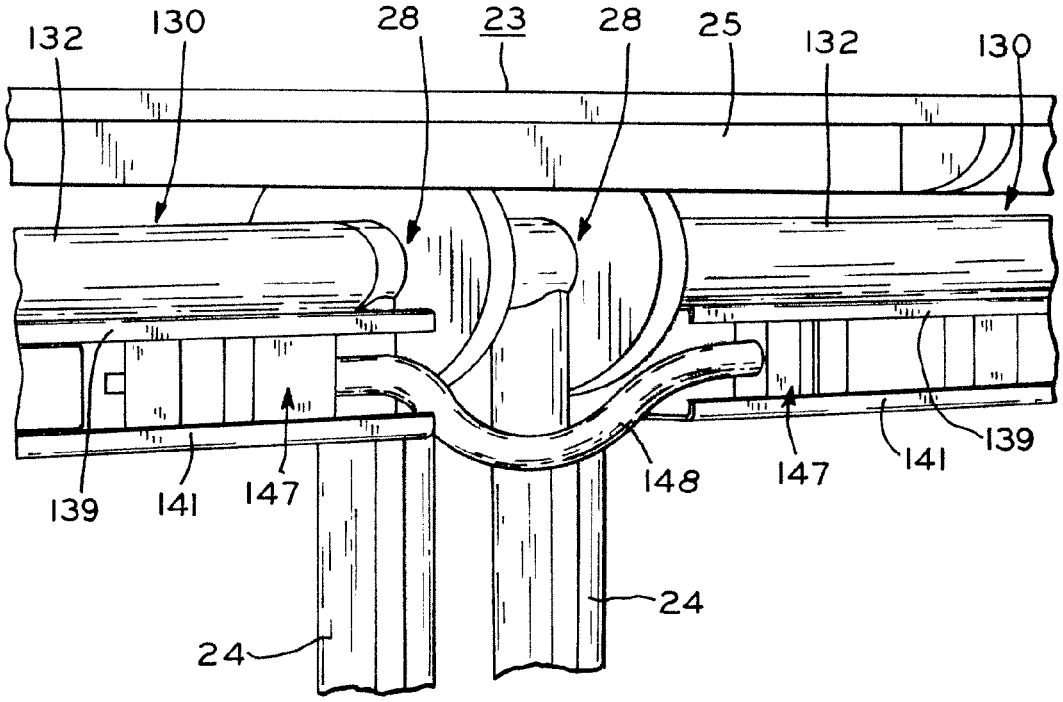
FIG. 6 is a perspective view of a portion of two tables, further illustrating an electrical jumper cable connecting the electrical harness assemblies of each table.

As shown in FIG. 6, electrical jumper connection 148 may be employed between two tables 20 having respective electrical harness assemblies 147 mounted within channels 130. In another embodiment, electrical harness assemblies 147 are dedicated outlets without electrical jumper connections 148 being required between tables 20.

In operation, as work surface 23 (FIG. 1) of table 20 is rotated from a vertical position (FIG. 1, solid lines) to a horizontal position (FIG. 1, dashed lines), channel 130 advantageously remains stationary such that openings 142 provide access to channel 130 which remains parallel to a floor surface upon which table 20 is positioned. Moreover, advantageously, any cables or other electrical/communication cords, for example, cords/cables 48 (FIG. 3), that are positioned in troughs 134 are not twisted or otherwise interfered with during rotational movement of work surface 23. Further, openings 142 are optionally provided on either side of channel 130 to provide access to channel 130 on either side of table 20.

Figure 7:
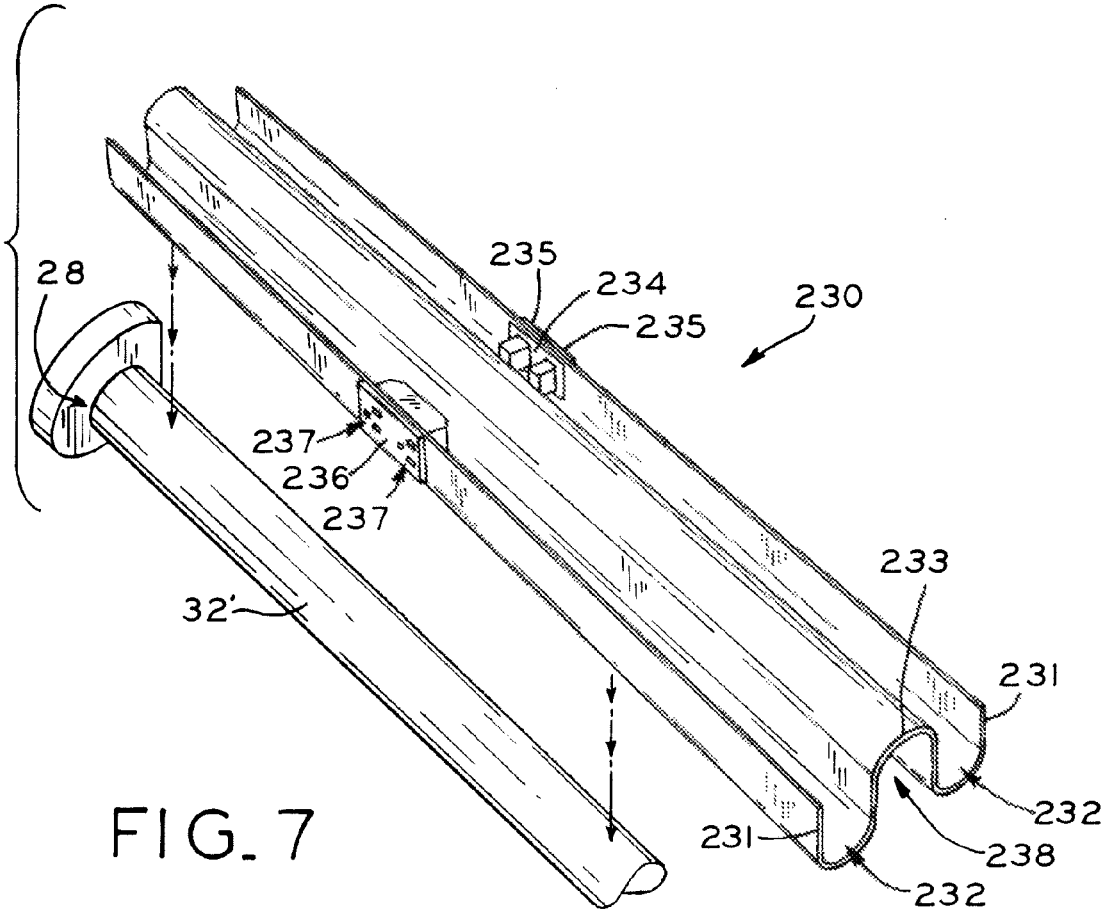
FIG. 7 is a perspective view of a channel according to another embodiment of the present invention.

Referring now to FIG. 7, another embodiment of a channel is shown as channel 230 and generally includes vertical sidewalls 231, troughs 232, and center U-shaped portion 233. Channel 230 may be formed from an extruded aluminum material, any other suitable metal or from a plastic material, or a combination of plastic and metal materials. In another form, channel 230 may be formed from stamped metal, such as stainless steel which is rolled into the shape of channel 230, for example. Troughs 232 are generally defined between each vertical sidewall 231 and center portion 233. At least one cutout portion may be provided in each vertical sidewall 231 for receipt of various modules, as described below. The cutout portion may be provided in channel 230 via a laser cut or other suitable cutting method. Center portion 233 defines cross bar trough 238. In operation, trough 238 may be positioned on a cross bar horizontal member 32' of table 20 (FIG. 1) and snap-fittingly engaged therewith, thereby maintaining channel 230 on cross bar horizontal member 32' of table 20.

In one example, electrical outlet module 236 may be mounted in a cutout portion in a vertical sidewall 231. Electrical outlet module 236 may include at least one AC and/or DC electrical outlet 237 which extends through the cutout portion beyond vertical sidewall 231 such that a user may easily access outlet 237. In another example, communication outlet module 234 may be mounted in another cutout portion in a vertical sidewall 231. Communication outlet module 234 may include at least one communication outlet 235 which extends through the cutout portion beyond vertical sidewall 231 such that a user may easily access outlet 235. Communication outlet module 234 may be an AMP-style data port, or any suitable telephone, cable, internet, or Ethernet connection.

Although shown positioned in different vertical sidewalls 231, electrical outlet module 236 and communication outlet module 234 may be positioned on the same vertical sidewall 231. Furthermore, more than one electrical outlet module 236 and communication outlet module 234 may be positioned in cutout portions of vertical sidewalls 231.

In operation, as work surface 23 (FIG. 1) of table 20 is rotated from a vertical, storage position (FIG. 1, solid lines) to a horizontal, use position (FIG. 1, dashed lines), channel 230 remains stationary such that the cutout portions retain electrical outlet module 236 and communication outlet module 234 fixed and parallel to the ground surface upon which table 20 is positioned, i.e., cross bar horizontal member 32' of table 20 is fixed and does not rotate with the rotational mechanisms 28 of the table. Moreover, any cables or other electrical/communication cords, for example, cords/cables 48 (FIG. 3), that are positioned in troughs 232 are not twisted or otherwise interfered with during rotational movement of work surface 23. Further, the cutout portions are optionally provided on either side of channel 230 to provide access to channel 230 on either side of table 20.

Figure 9:
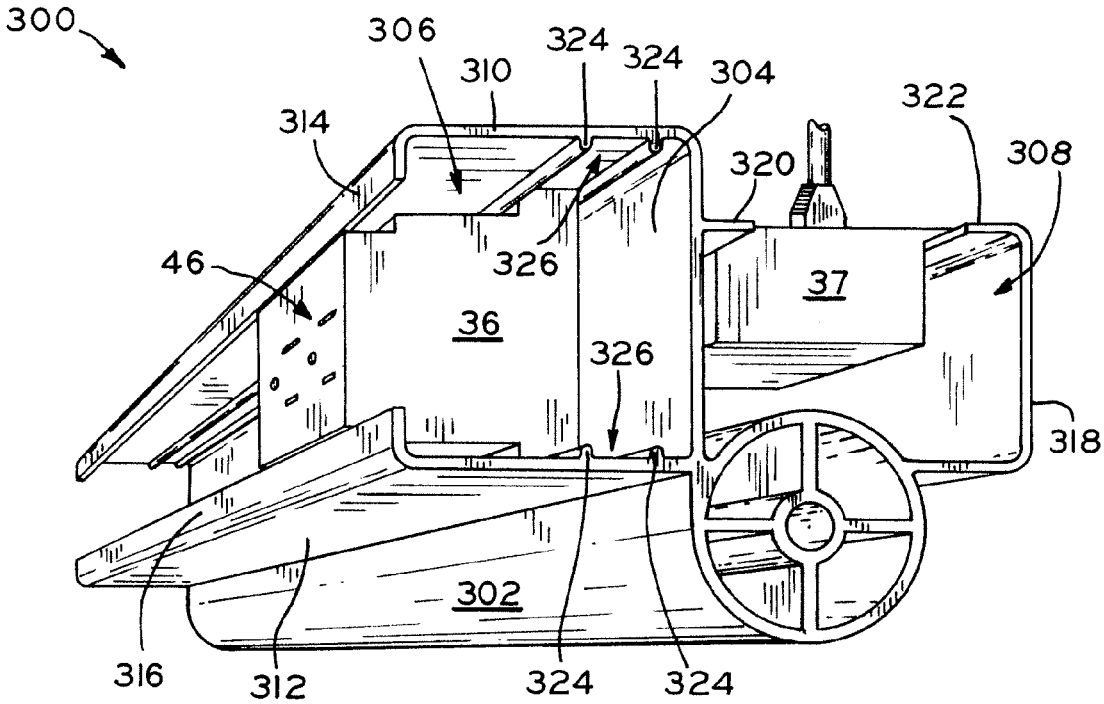
FIG. 9 is a perspective end view of the channel of the table of FIG. 8, showing an electrical outlet module in one trough thereof and a data outlet module in another trough thereof.
Figure 10:
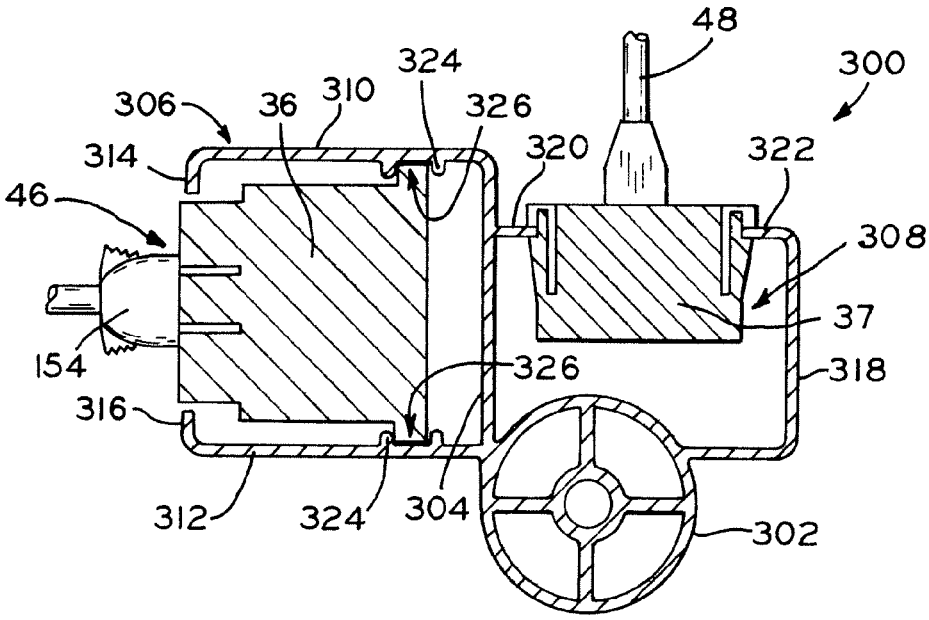
FIG. 10 is a sectional view taken along line 10-10 of FIG. 9.

Referring to FIGS. 8-10, table 20 is shown with another channel 300 in accordance with another embodiment of the present invention which, except as described below, includes features that are identical or substantially identical to those of channels 30 and 130 described above. Channel 300 may be formed of extruded aluminum, or any other suitable metal and/or rigid plastic material, and generally includes a crossbar 302 which may form a structural component of support structure 27 of table 20 that supports work surface 23.

Channel 300 includes a central vertical wall 304 and first and second troughs 306 and 308. First trough 306 is defined by upper horizontal flange 310 and lower horizontal flange 312, and includes a horizontally-facing opening defined between vertical flanges 314 and 316 which depend from flanges 310 and 312, respectively. Second trough 308 is defined by central vertical wall 304 and vertical flange 318, and includes a vertically-facing opening defined between horizontal flanges 320 and 322 which depend from wall 304 and flange 318, respectively.

As is apparent from FIGS. 8-10, first and second troughs 306 and 308 are located generally vertically above crossbar 302, as opposed to the above-described embodiments in which the troughs are located generally below the crossbar of the channel.

First trough 306 may additionally include other flanges 324 defining channels 326 within trough 306 for slidable receipt of electrical outlet modules 36 and/or harness assemblies 147 in a manner described above. Additionally, individual electrical outlet modules 36 may be snap-fittingly received within the opening defined between flanges 314 and 316 and retained by flanges 314 and 316 in the same manner as described in detail above with respect to channel 30.

Second trough 308 may receive individual communication outlet modules 37 within the opening defined between flanges 320 and 322, which modules 37 may be snap-fittingly retained by flanges 320 and 322 in the same manner as described in detail above with respect to channel 30.

Referring to FIG. 8 and as described above, it may be seen that first trough 306 faces generally horizontally, while second trough 308 faces generally vertically. In this manner, when work surface 23 is moved from its horizontal, use position to its vertical, storage position shown in FIG. 8, first trough 306 and the electrical and/or communications modules 36 and/or 37 therein are readily accessible, while the electrical and/or communications modules 36 and/or 37 within second trough 308, which faces vertically, are also readily accessible and are not blocked by work surface 23 when work surface 23 is in its vertical position.

In this manner, a user may easily access electrical and/or communication modules 36 and 37 within troughs 306 and 308 when work surface 23 is in its vertical position, and may thereafter move work surface 23 to its horizontal use position in which the user may use peripheral devices such as computers, projectors, etc., on work surface 23 with power and/or data provided to such peripheral devices via channel 300. Additionally, as also described above with respect to channels 30 and 130, any wires present within channel 300 are not twisted or interfered with as work surface 23 is moved between its vertical, storage position and its horizontal, use position. Additionally, such wires may extend between multiple channels 300 and multiple tables 20 to serially link the electrical and communication services between the tables 20.

Figure 11:
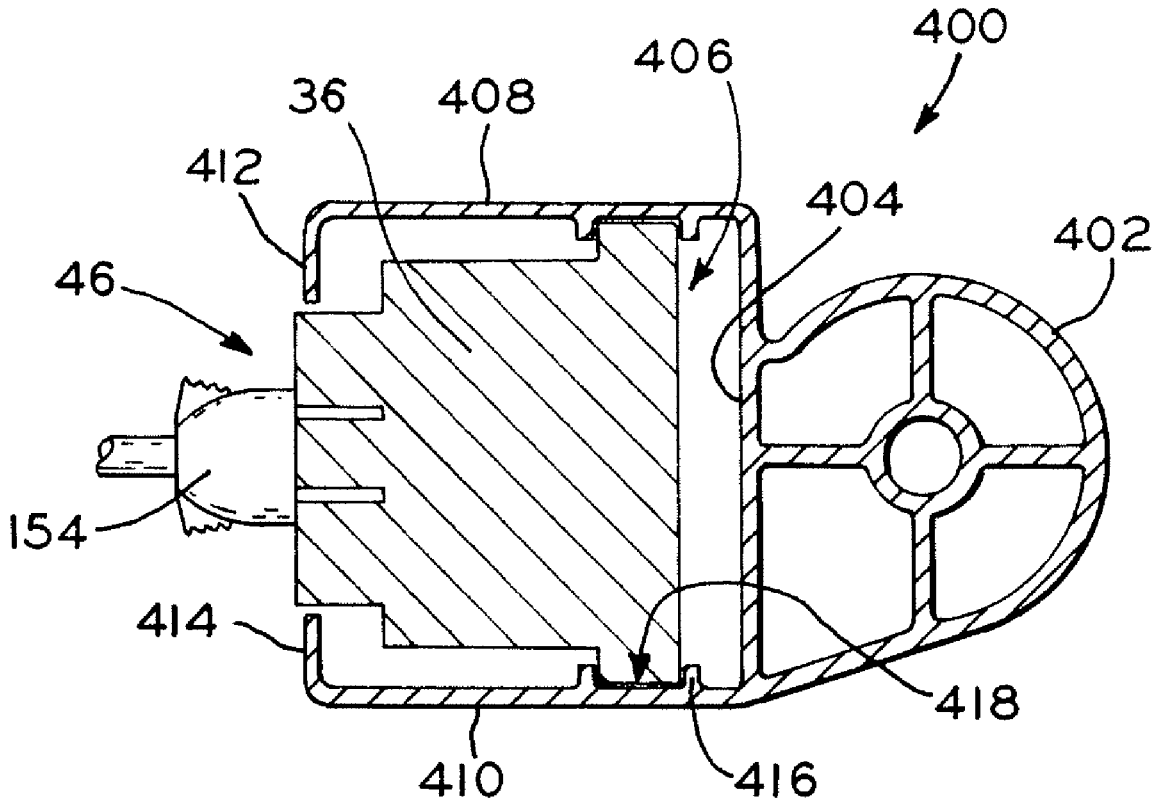
FIG. 11 is a sectional view of a channel according to a further embodiment.

Referring to FIG. 11, another channel 400 in accordance with another embodiment of the present invention which, except as described below, includes features that are identical or substantially identical to those of channels 30, 130 and 300 described above and which may receive outlet and data modules in the same manner. Channel 400 may be formed of extruded aluminum, or any other suitable metal and/or rigid plastic material, and generally includes a crossbar 402 which may form a structural component of support structure 27 of table 20 that supports work surface 23.

Channel 400 includes a central vertical wall 404 and a single trough 406 which, as shown in FIG. 11, is disposed at substantially the same vertical level as cross bar 402. In particular, the center of cross bar 402 is located on a horizontal line which substantially horizontally bisects trough 406. Trough 406 is defined by upper horizontal flange 408 and lower horizontal flange 410, and includes a horizontally-facing opening defined between vertical flanges 412 and 414 which depend from flanges 408 and 410, respectively.

Trough 400 may additionally include other flanges 416 defining channels 418 within trough 400 for slidable receipt of electrical outlet modules 36 and/or harness assemblies 147 in a manner described above. Additionally, individual electrical outlet modules 36 may be snap-fittingly received within the opening defined between flanges 412 and 414 and retained by flanges 412 and 414 in the same manner as described in detail above with respect to channel 30.

While this invention has been described as having exemplary embodiments and scenarios, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A table, comprising:

a pair of spaced upright supports;

a work surface;

a pair of spaced rotation mechanisms positioned beneath said work surface at respective upper ends of said spaced upright supports, said work surface pivotable via said rotation mechanisms about a horizontal pivot axis defined by a stationary cross bar, between a horizontal position and a vertical position;

a horizontal channel disposed beneath and spaced from said work surface when said work surface is in said horizontal position, said channel disposed between said rotation mechanisms, said channel including a first trough and a second trough disposed side by side in a horizontal direction, wherein a central web is vertically disposed between said first and second troughs, said first trough having an opening facing in a horizontal direction and said second trough having an opening facing in a vertical direction said first and second troughs integrally formed with said cross bar; and at least one outlet module removably mountable within at least one of said first and second troughs.

2. The table of claim 1, wherein said channel remains stationary when said work surface is moved between said horizontal and vertical positions.

3. The table of claim 1, wherein said at least one outlet module is selected from an electrical outlet module and a communications module.

4. The table of claim 1, wherein said at least one outlet module is accessible externally from said channel.

5. The table of claim 1, wherein said at least one outlet module is snap-fittingly mounted within one of said troughs.

6. The table of claim 1, wherein:

at least one of said first and second troughs includes a first pair of parallel flanges and a second pair of parallel flanges, respectively defining a first guidance channel and a second guidance channel, each guidance channel extending between a first end and a second end of said horizontal channel, said first and second guidance channels disposed in a mutually facing and substantially parallel relationship, said outlet module separate from said horizontal channel and including a first portion and a second portion, said first guidance channel sized to receive said first portion, said second guidance channel sized to receive said second portion, said first and second portions slidably received in said respective guidance channels.

7. The table of claim 1, wherein said outlet module is slidably received within said channel.

8. The table of claim 1, wherein said first and second troughs are disposed substantially above said cross bar.

9. The table of claim 1, wherein said outlet module extends at least partially through said opening of one of said first and second troughs.

* * * * *